US010366587B2

(12) United States Patent
Fadeyi et al.

(10) Patent No.: US 10,366,587 B2
(45) Date of Patent: Jul. 30, 2019

(54) AUDIBLE SENSOR CHIP

(71) Applicants: Mobel Fadeyi, Denver, CO (US); Segun Oke, Denver, CO (US)

(72) Inventors: Mobel Fadeyi, Denver, CO (US); Segun Oke, Denver, CO (US)

( * ) Notice: Subject to any disclaimer, the term of this patent is extended or adjusted under 35 U.S.C. 154(b) by 174 days.

(21) Appl. No.: 15/426,195

(22) Filed: Feb. 7, 2017

(65) Prior Publication Data

US 2018/0225942 A1 Aug. 9, 2018

(51) Int. Cl.
*G08B 13/196* (2006.01)

(52) U.S. Cl.
CPC ..... *G08B 13/19632* (2013.01)

(58) Field of Classification Search
CPC ..... H04R 2499/11; G08B 13/19636
USPC ..... 381/124, 334, 365
See application file for complete search history.

(56) References Cited

U.S. PATENT DOCUMENTS

2013/0279706 A1* 10/2013 Marti ..... G06F 3/165 381/57
2014/0044286 A1* 2/2014 Coles ..... G06F 1/1688 381/150
2014/0219482 A1* 8/2014 Jia ..... H04R 5/02 381/300
2015/0096352 A1* 4/2015 Peterson ..... F24F 11/30 73/31.02
2017/0064060 A1* 3/2017 Agrawal ..... H04W 24/02

* cited by examiner

*Primary Examiner* — William A Jerez Lora

(57) ABSTRACT

An audible sensor chip that includes: a base border; speakers on opposing sides of the chip; a control processor; and a camera. The speakers may include four speakers, where two speakers are on each side of a center console. Preferably, the camera is positioned at the center of the console.

2 Claims, 1 Drawing Sheet

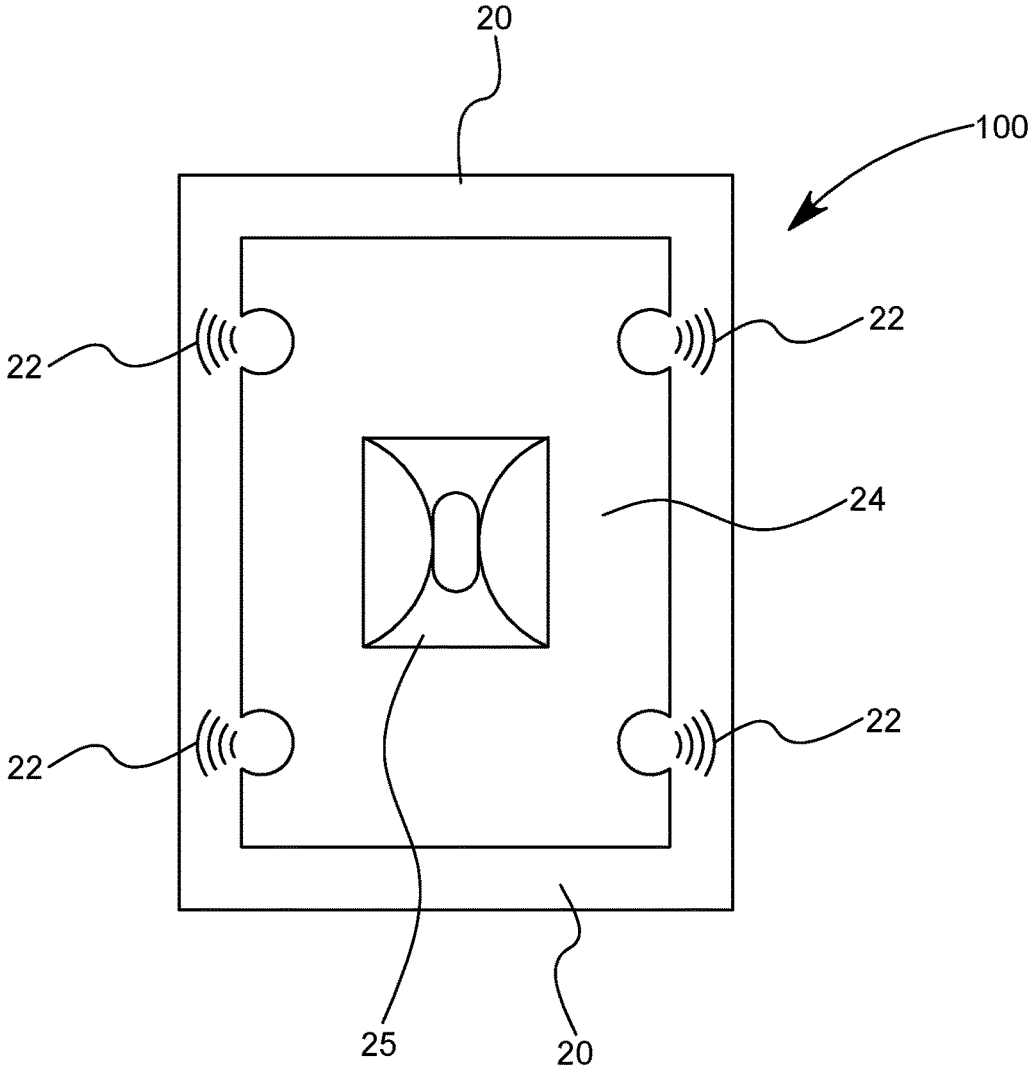
20
100
22
22
24
22
22
25
20

AUDIBLE SENSOR CHIP

BACKGROUND OF THE INVENTION

Field of Invention

The present invention relates to an audible sensor chip that is mountable to provide security in various locations.

Description of Related Art

Security systems are readily available in various forms and for various facilities, buildings, homes and other locations. The typical security system includes sensors to detect motion, recording capabilities in terms of cameras and audible alarms to alert of intrusion. The object of the present invention is to provide an improvement onto existing alarm systems, cameras and computers to provide a sensor chip to provide audible alerts from a series of speakers.

SUMMARY OF THE INVENTION

The present invention relates to an audible sensor chip that includes: a base border; speakers on opposing sides of the chip; a control processor; and a camera. The speakers may include four speakers, where two speakers are on each side of a center console. Preferably, the camera is positioned at the center of the console.

BRIEF DESCRIPTION OF DRAWINGS

FIG. 1 depicts an audible sensor chip in accordance with the present invention.

DETAILED DESCRIPTION

The present invention relates to audible sensor chip that is used to emit audible alerts through a series of speakers. This audible alert provides accessory or addition to an existing alarm system therefore alerting of any suspicious behavior or particular movement. The security sensor chip according to present inventions includes a camera with speakers surrounding the camera on a mountable console. The console includes a magnetic base that allows the magnetic mounting of the sensor chip. Once magnetically mounted the sensor chip has a camera that operates to detect movement. Any movement detected can therefore trigger audible alerts from speakers on the sensor chip.

In reference to FIG. 1, a sensor chip 100 is depicted. The sensor chip 100 includes a rectangular base border 20 with a magnetic attribute. This feature allows the sensor chip 100 to be easily mounted onto a metal surface as needed by the user. Speakers 22 are provided on opposing sides of the sensor chip 100 on the border of a center console 24. At the center of the center console 24 is a camera 25 that detects movement. Appropriate processing controls are provided within the sensor chip 100 to detect movement through the camera 25 and then emit audible alerts through speakers 22 on each opposing side of the center console 24. The magnetic attributes of the base border 20 allows for easy mounting of the sensor chip in any position needed by the user. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The exemplary embodiment was chosen and described in order to best explain the principles of the invention and its practical application, to thereby enable others skilled in the art to best utilize the invention and various embodiments with various modifications as are suited to the particular use contemplated.

What is claimed is:

1. An audible sensor comprising:

a housing containing a based border with a magnetic attribute;

a control processor coupled to a camera and speakers;

the camera located at a front of the housing and align on a center of the housing and adapted for motion detection;

the speakers including four speakers located at the front of the housing and symmetrically align around the camera, where two speakers are on one side of the camera and the other two speakers on an opposite side of the camera;

wherein the control processor provides an audible alert using the speakers when a movement is detected by the camera.

2. The audible sensor of claim 1, further comprising the magnetic attribute for allowing the audible sensor to be easily mounted onto a metal surface.

* * * * *